US005867908A

United States Patent [19]

Van Veen et al.

[11] Patent Number: 5,867,908

[45] Date of Patent: Feb. 9, 1999

[54] SHAVING APPARATUS

[75] Inventors: Gerardus N. A. Van Veen; Andreas J. Garenfeld, both of Eindhoven, Netherlands

[73] Assignee: U.S. Philips Corporation, New York, N.Y.

[21] Appl. No.: 857,758

[22] Filed: May 15, 1997

[30] Foreign Application Priority Data

May 31, 1996 [EP] European Pat. Off. ..... 96201514

[51] Int. Cl.[6] ..... B26B 19/04

[52] U.S. Cl. ..... 30/43.6; 30/43.9; 30/346.51

[58] Field of Search ..... 30/43.6, 43.9, 30/43.92, 346.51

[56] References Cited

U.S. PATENT DOCUMENTS

| | | | |
|---|---|---|---|
| 2,324,070 | 7/1943 | Dalkowitz | 30/43.6 |
| 2,359,880 | 10/1944 | Scully | 30/43.6 |
| 2,494,464 | 1/1950 | Vivie et al. | 30/43.6 |
| 2,619,719 | 12/1952 | Schaufelberger | 30/43.9 |
| 2,877,548 | 3/1959 | Starre | 30/43.6 |
| 3,281,937 | 11/1966 | Starre et al. | 30/43.6 |
| 3,564,715 | 2/1971 | Driessen et al. | 30/346.51 |
| 3,815,232 | 6/1974 | Liska | 30/346.51 |
| 4,882,840 | 11/1989 | Tietjens | 30/43.6 |

FOREIGN PATENT DOCUMENTS

| | | |
|---|---|---|
| 909666 | 4/1954 | Germany . |
| WO9529042 | 11/1995 | WIPO . |

*Primary Examiner*—Hwei-Siu Payer
*Attorney, Agent, or Firm*—Ernestine C. Bartlett

[57] ABSTRACT

A shaving apparatus has at least one cutting unit (3) comprising an external cutting member (4) and an internal cutting member (5) which is drivable relative thereto, which external cutting member (5) has a number of broad and narrow hair-entry apertures (7*a*, 7*b*) which are bounded by peripheral portions (12, 13) of the external cutting member. In order to enable both short and long hairs to be caught and severed effectively while irritation of the skin is avoided as far as possible, the peripheral portions (12, 13) bounding the hair-entry apertures (7*a*, 7*b*) have different thicknesses, the width (B1) of a hair-entry aperture (7*a*) between two thick peripheral portions (12) being greater than the width (B2) of a hair-entry aperture (7*b*) between two thin peripheral portions (13).

2 Claims, 8 Drawing Sheets

SHAVING APPARATUS

FIELD OF THE INVENTION

The invention relates to a shaving apparatus having at least one cutting unit comprising an external cutting member and an internal cutting member which is drivable relative to said external cutting member, which internal cutting member comprises cutting elements having cutting edges, which external cutting member has a plurality of broad and narrow hair-entry apertures which are bounded by peripheral portions of the external cutting member, which peripheral portions have cutting edges for cooperation with the cutting edges of the internal cutting member, a plane common to the cutting edges defining a cutting surface.

BACKGROUND OF THE INVENTION

Such a shaving apparatus is known from DE 909 666. The presence of broad and narrow hair-entry apertures serves to improve the shaving performance. Longer hairs are more likely to be caught in broad hair-entry apertures than in narrow hair-entry apertures. Shorter hairs will also be caught satisfactorily in narrow hair-entry apertures. It is also known that with the same pressure of the shaving apparatus on the skin the skin bulges deeper into broad hair-entry apertures than into narrow hair-entry apertures. A drawback of the presence of broad and narrow hair-entry apertures in the same external cutting member is that skin irritation may occur as a result of the fact that the skin penetrates too far into a broad aperture and may come into contact with the internal cutting member.

SUMMARY OF THE INVENTION

It is an object of the invention to improve the shaving performance of a shaving apparatus of the type defined in the opening paragraph, enabling both short and long hairs to be caught and severed effectively, while irritation of the skin is avoided as far as possible.

To this end the shaving apparatus in accordance with the invention is characterized in that the peripheral portions which bound the hair-entry apertures, viewed in a direction perpendicular to the cutting surface, have different thicknesses, the width of a hair-entry aperture between two thick peripheral portions being greater than the width of a hair-entry aperture between two thin peripheral portions.

This provides a more efficient hair catching system. Longer hairs are more readily caught in the broader hair-entry apertures, whereas in the case that the skin bulges through a broader aperture the likelihood of the internal cutting member touching the skin is minimal owing to the thicker peripheral portions. Hairs which have not been severed close enough in the broad hair-entry apertures are readily caught and severed further in the narrow hair-entry apertures.

A shaving apparatus based on the same inventive concept and having at least one cutting unit comprising an external cutting member and an internal cutting member which is drivable relative to said external cutting member, which internal cutting member comprises at least one cutter rim having a cutting edge at both sides, which external cutting member has at least one slot-shaped hair-entry aperture which is bounded by peripheral portions of the external cutting member, which peripheral portions have cutting edges for cooperation with the cutting edges of the internal cutting member, a plane common to the cutting edges defining a cutting surface, is characterized in that the peripheral portions which bound the hair-entry aperture, viewed in a direction perpendicular to the cutting surface, have alternate areas of different thickness, the width of a hair-entry aperture between two thick peripheral portions being greater than the width of the hair-entry aperture between two thin peripheral portions. In such a shaving apparatus one slot-shaped hair-entry aperture has a varying width, a broader aperture being obtained between two facing thick peripheral portions than between two facing thin peripheral portions. In a way similar to that described hereinbefore this results in a more efficient hair catching system and hence a better shaving performance.

BRIEF DESCRIPTION OF THE DRAWINGS

The invention will now be described in more detail with reference to some exemplary embodiments shown diagrammatically in the drawings, in which.

DETAILED DESCRIPTION OF THE PREFERRED EMBODIMENTS

Figure 1:
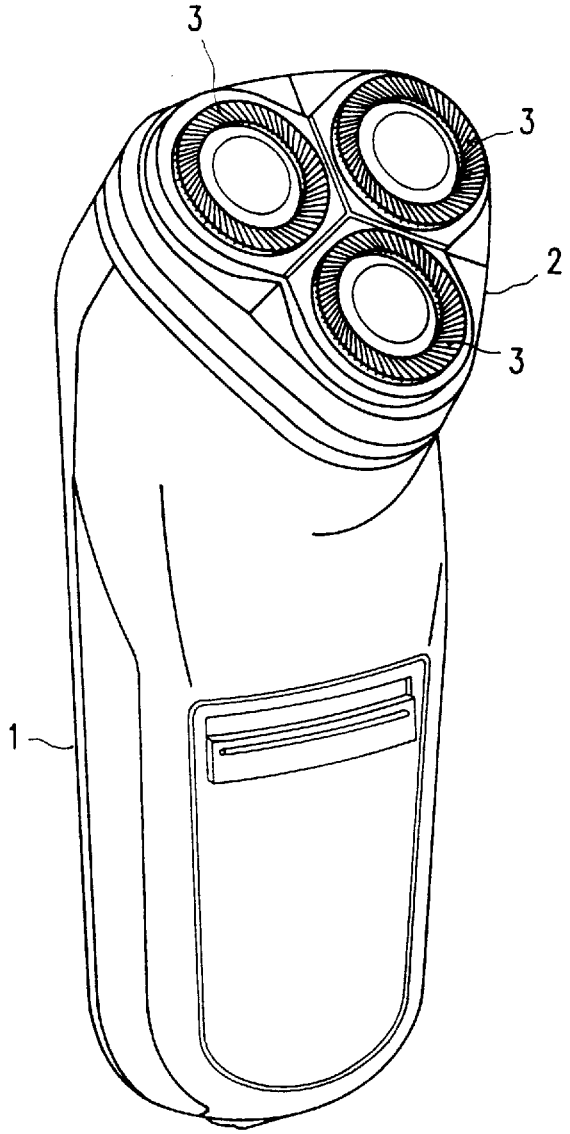
FIG. 1 shows an example of a first shaving apparatus of a rotary type.

The shaving apparatus shown in FIG. 1 has a housing 1 with a holder 2, in which three cutting units 3 are mounted. Each cutting unit comprises an external cutting member 4 and an internal cutting member 5.

Figure 2:
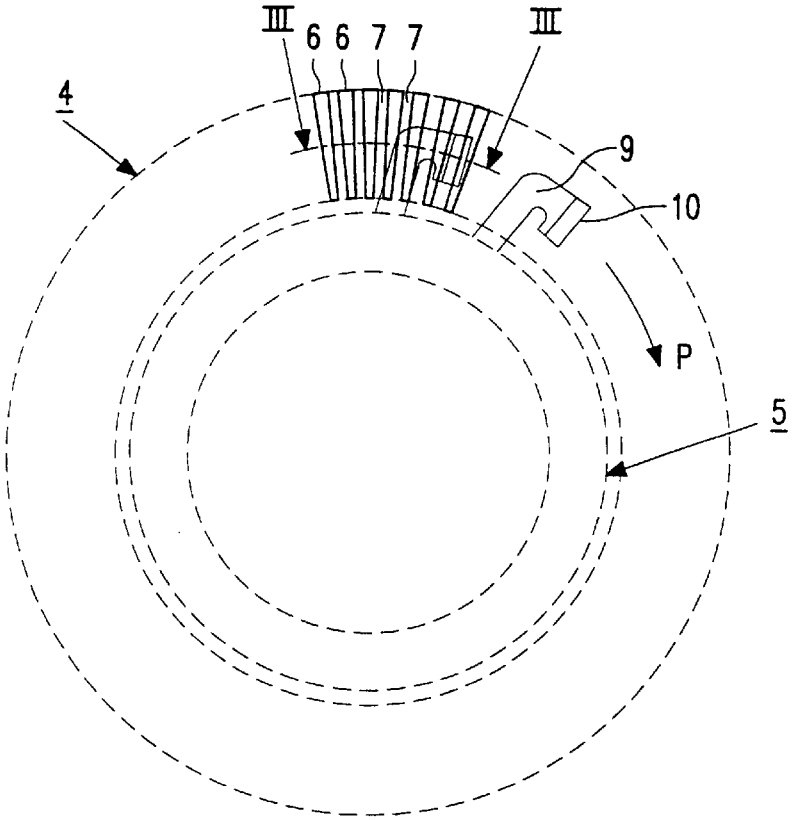
FIG. 2 shows an external cutting member for the apparatus shown in FIG. 1, FIGS. 3, 4 and 5 are cross-sectional views taken on the line III—III in FIG. 2, showing different cross-sectional profiles.
Figure 3:
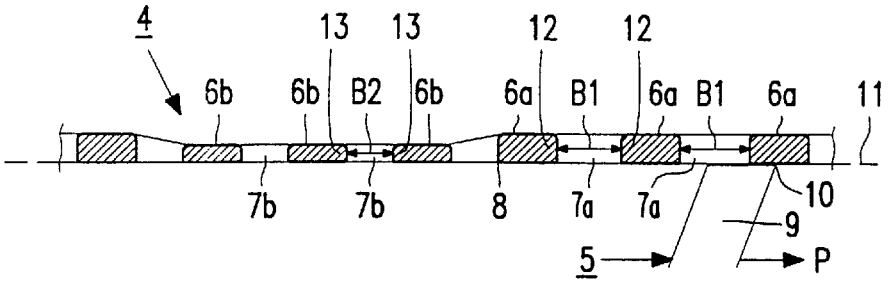
Figure 4:
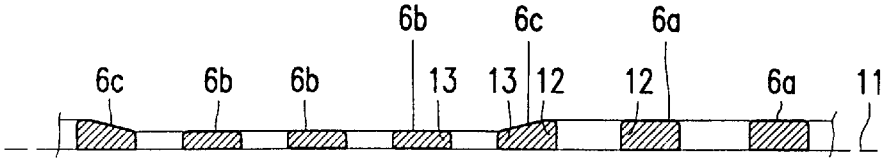
Figure 5:
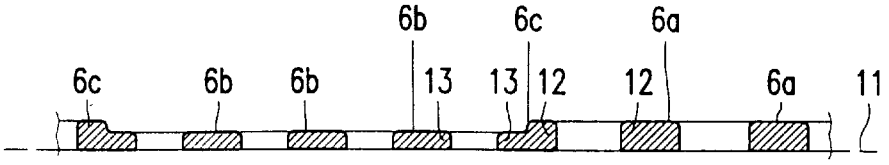
Figure 6:
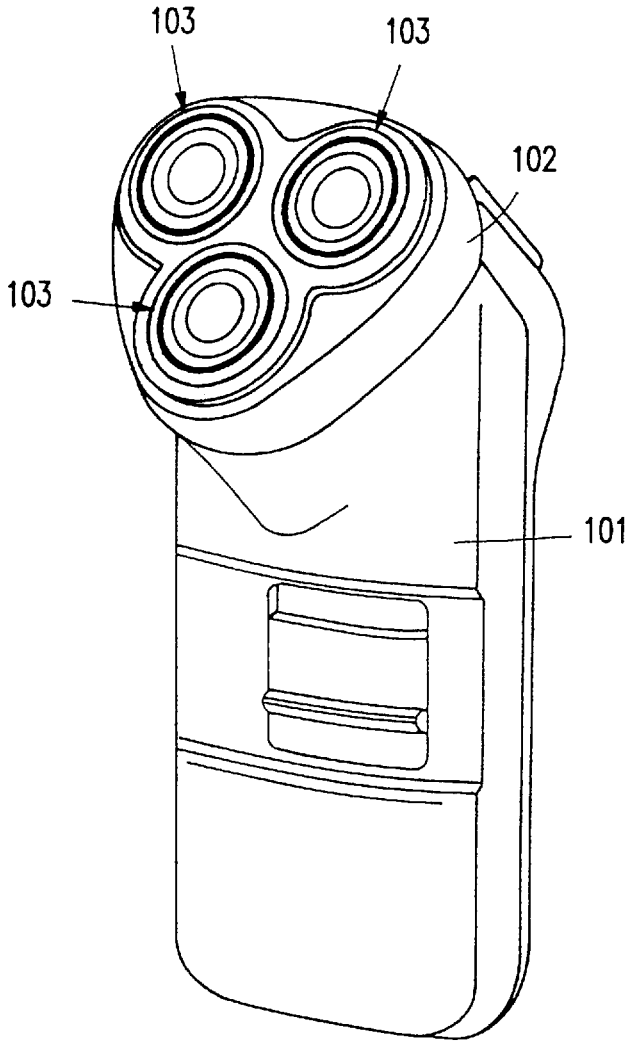
FIG. 6 shows an example of a second shaving apparatus of another rotary type.
Figure 7:
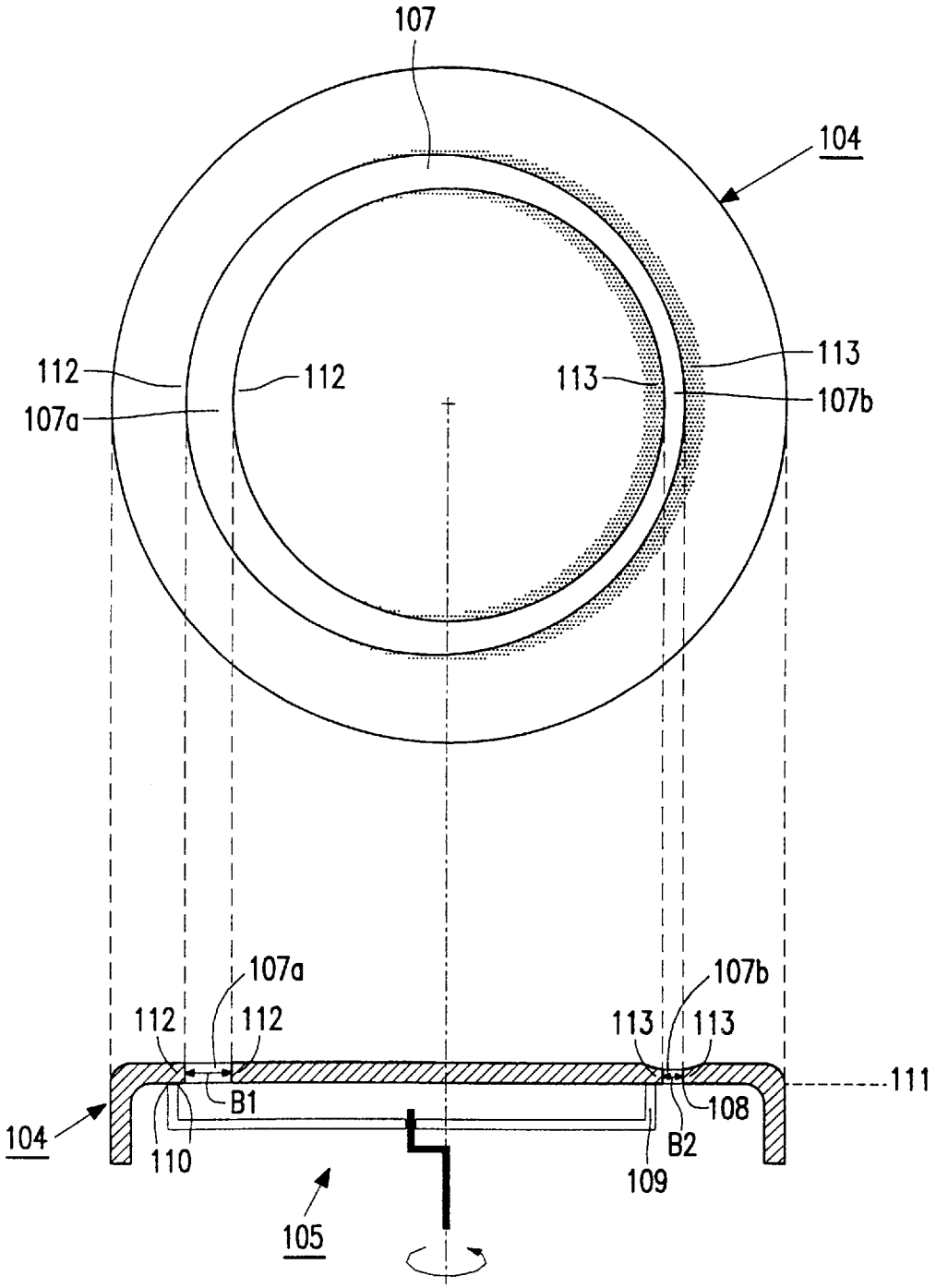
FIG. 7 shows an external cutting member for the apparatus shown in FIG. 6.

FIG. 2 is a plan view showing a part of the external cutting member 4 of the apparatus shown in FIG. 1. This cutting member comprises a large number of radially oriented lamellae 6 between which slot-shaped hair-entry apertures 7 are disposed. The internal cutting member 5 has a plurality of cutting elements 9 and is driven in the direction indicated by an arrow P with the aid of a drive means which is known but not shown. FIG. 3 is a cross-sectional view showing a first example of a lamella configuration. The undersides of the lamellae 6 have cutting edges 8 for cooperation with cutting edges 10 of the cutting elements 9. The plane in which the cutting edges 8, 10 are disposed is referred to as the cutting plane 11. The peripheral portions of the lamellae 6, which portions bound the hair-entry aperture, bear the reference numerals 12 and 13. Thick (6*a*) and thin (6*b*) lamellae are disposed in a direction transverse to the cutting plane 11. A broad hair-entry aperture 7*a* having a width B1 is situated between two thick lamellae 6*a* and a narrow hair-entry aperture 7*b* having a width B2 is situated between two thin lamellae 6*b*. Between a thick lamella 6*a* and a thin lamella 6*b* the hair-entry aperture can be slightly wider than between two thin lamellae 6*b* but, at any rate, it should not be as wide as between two thick lamellae 6*a*. In the present example, both the thick lamellae 6*a* and the thin lamellae 6*b* are of constant thickness. FIGS. 4 and 5 show two examples in which a lamella 6*c*, which at one of its sides adjoins a broad hair-entry aperture 7*a* and which at its other side adjoins a narrow hair-entry aperture 7*b*, has such a cross-sectional profile that the peripheral portion 12 adjoining a broad aperture is thick and the peripheral portion 13 adjoining a narrow aperture is thin. FIG. 4 shows such a lamella 6*c* with a continuous transition and FIG. 5 with a stepped transition between the peripheral portions 12–13.

Figure 8:
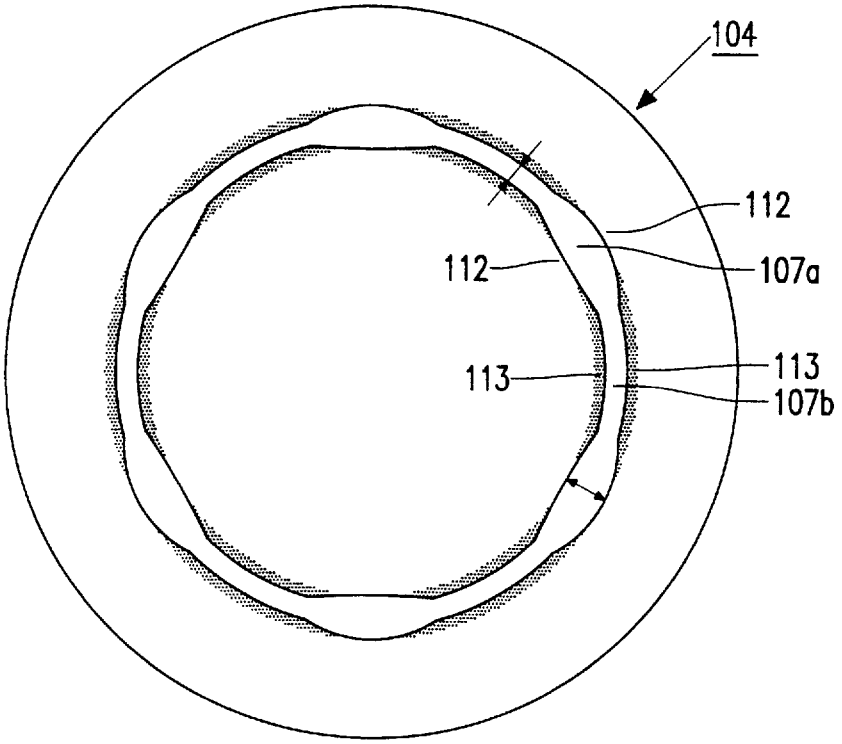
FIG. 8 shows another example of an external cutting member for the apparatus of FIG. 6.
Figure 9:
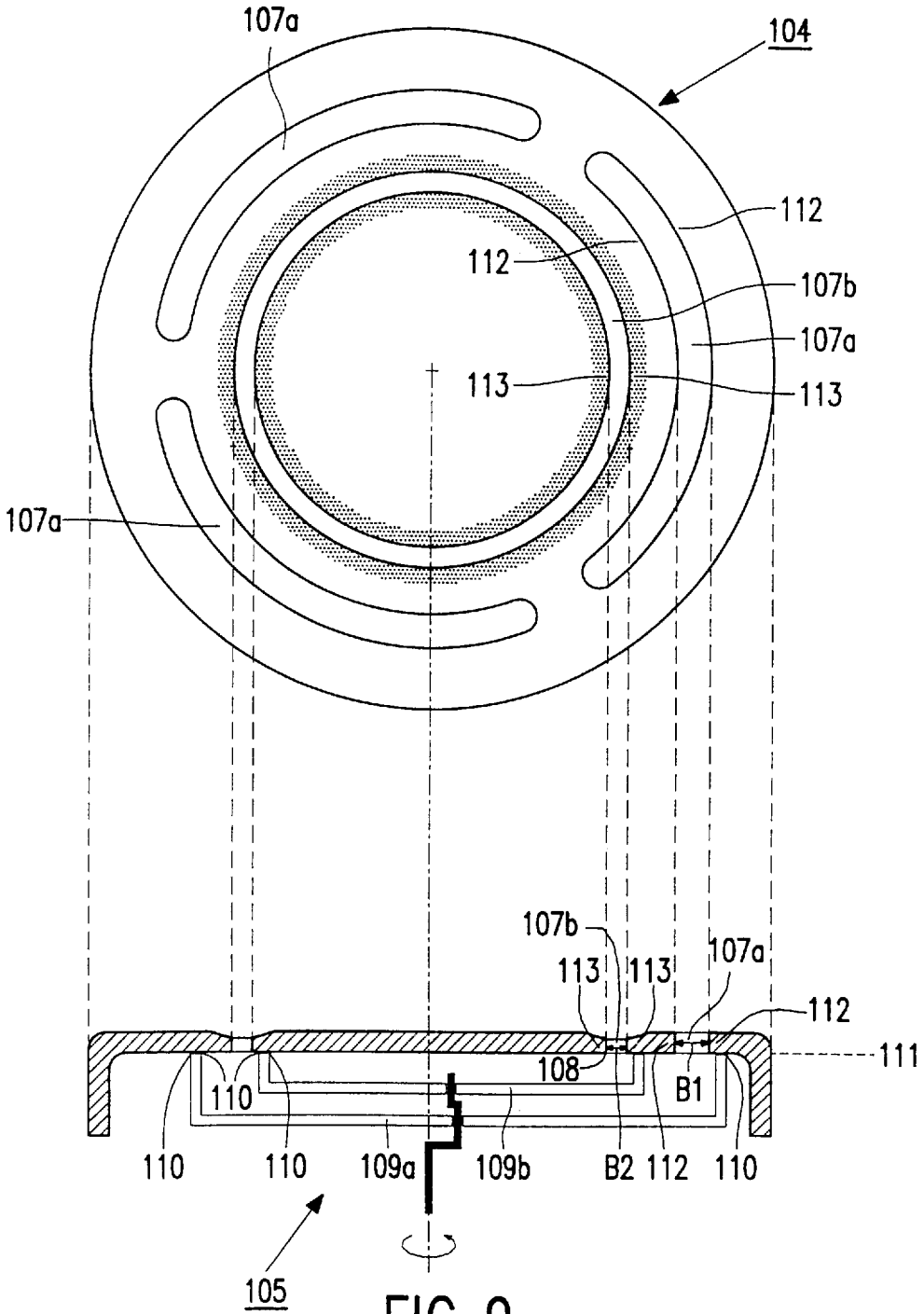
FIG. 9 shows yet another example of an external cutting member for the apparatus of FIG. 6.

FIGS. 6, 7, 8 and 9 show examples of an external cutting member of a rotary shaving apparatus as described in EP 0 705 158 A1 which corresponds substantially to U.S. Pat. No. 5,692,303 issued Dec. 2, 1997. In the example shown in FIG. 6 in which the shaving apparatus has a housing 101 with a holder 102, in which three cutting units 103 are mounted, the external cutting member 104 has one circular hair-entry aperture 107. The hair-entry aperture is bounded by peripheral portions 112, 113. The internal cutting member 105 is formed by a ring 109 having cutting edges 110 which cooperate with cutting edges 108 of the peripheral portions 112, 113 of the external cutting member 104. The cutting plane 111 is defined as the plane in which the cutting edges are disposed. The internal cutting member is driven in accordance with an eccentric movement. The width of the circular aperture varies from narrow (107*b*) to wide (107*a*) and then to narrow (107*b*) again. At the locations where the hair-entry aperture 107*b* is narrow, the peripheral portions 113 of the aperture, viewed in a direction perpendicular to the cutting plane 111, are thinner than at locations where the aperture 107*a* is wider. The thin peripheral portions 113 are shown as shaded areas. The example in FIG. 8 is a variant of that shown in FIG. 7. The width of the hair-entry aperture 107 now varies several times from narrow to wide along 360°. At the locations where the hair-entry aperture 107*a* is wide, the peripheral portions 112 are thick, and at the locations where the hair-entry aperture 107*b* is narrow, the peripheral portions 113 are thin, as a result of which alternate areas of different widths are obtained. In the external cutting member 104 shown in FIG. 9 a circular narrow hair-entry aperture 107*b* is surrounded by three partly circular broad apertures 107*a*. The narrow circular aperture 107*b* is bounded by peripheral portions 113 of smaller width than the peripheral portions 112 which bound the surrounding broad apertures 107*a*. In the present example the internal cutting member 105 is formed by two rings 109*a*, 109*b* both having cutting edges 110 which cooperate with the cutting edges 108 of the outer hair-entry apertures 107*a* and the inner hair-entry aperture 107*b*, respectively. Both rings are driven eccentrically, the eccentricity of the outer cutting ring 109*a* being slightly greater than that of the inner cutting ring 109*b*. The reason for this is that the outer apertures 107*a* are wider than the inner aperture 107*b*.

Figure 10:
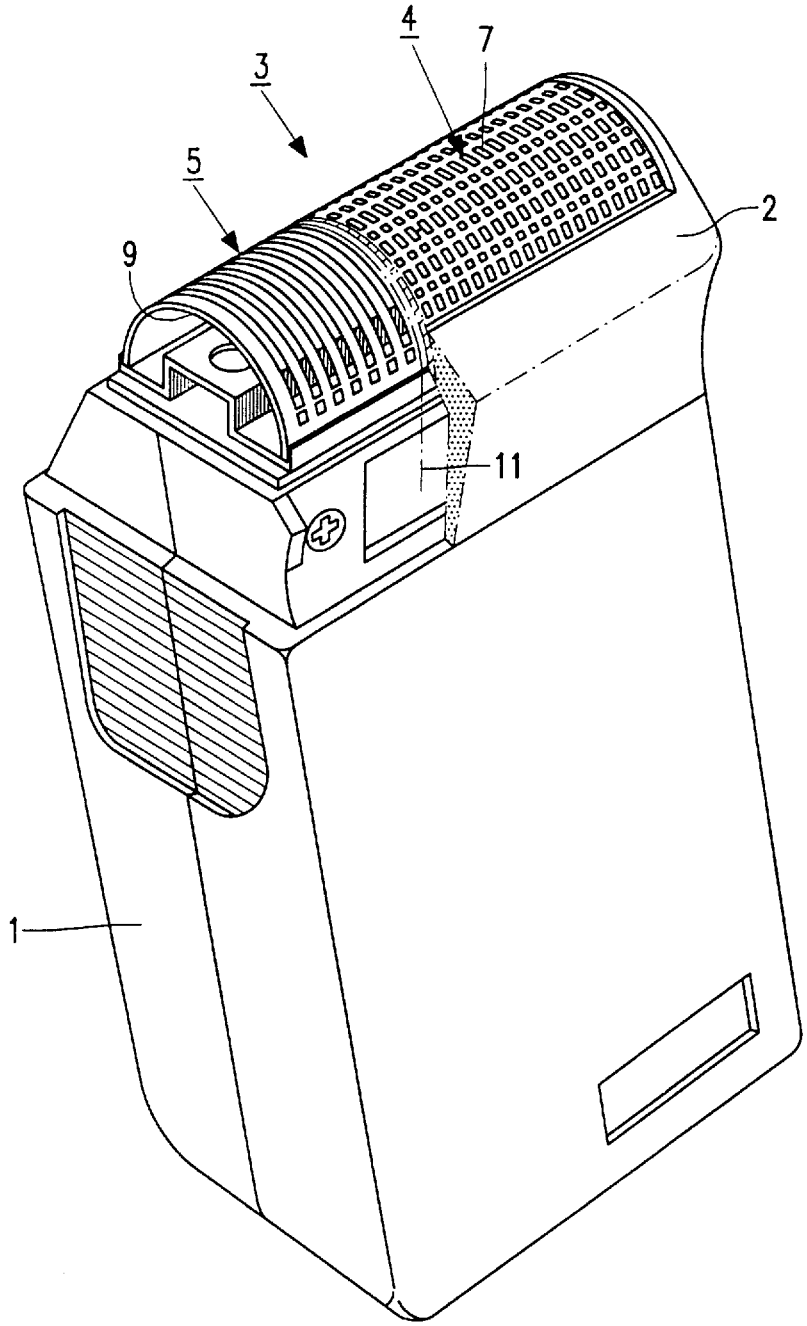
FIG. 10 shows an example of a third shaving apparatus of a vibratory type.
Figure 11:
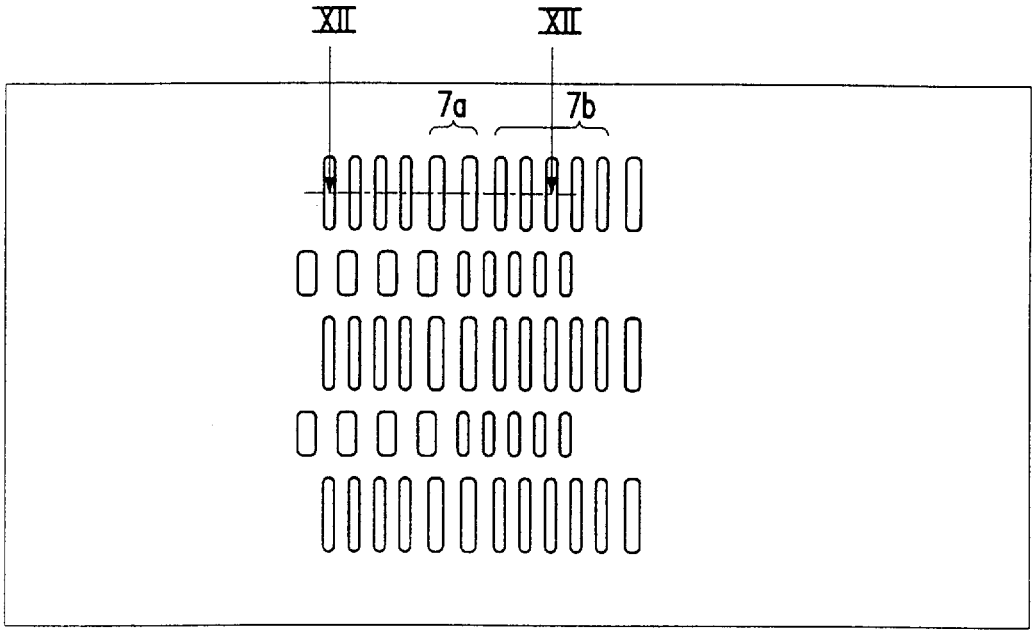
FIG. 11 shows an example of an external cutting member for the apparatus of FIG. 10.
Figure 12:
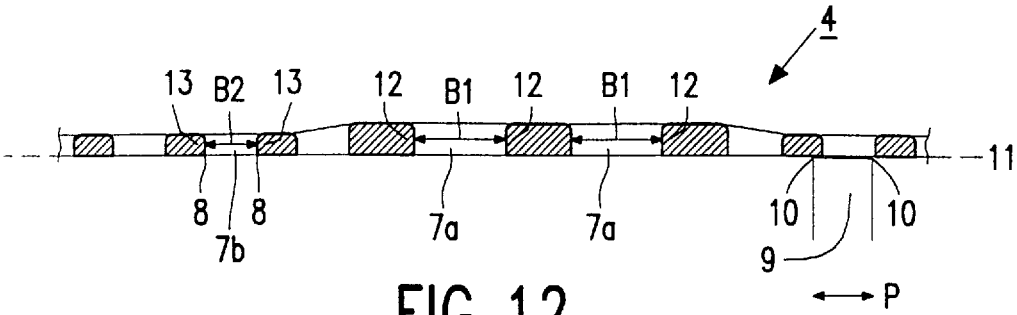
FIG. 12 is a cross-sectional view taken on the line XI—XI in FIG. 11.

FIG. 10 shows a vibratory shaving apparatus. The external cutting member 4 generally comprises an arcuate metal foil having a multitude of hair-entry apertures 7. An internal cutting member 5 reciprocates underneath and cooperates with the foil. The cutting surface 11 is arcuate and is defined by the concave underside of the foil with which the cutting edges 10 of the cutting elements 9 engage. FIGS. 11 and 12 show an example of such a foil. The foil has, for example, five rows of apertures. Three rows comprise long slot-shaped apertures and two rows interposed between these three rows comprise slightly shorter apertures. In the row with long apertures two broad apertures 7*a* are interposed between every five narrow apertures 7*b*. FIG. 12 shows that the peripheral portions 12 of the foil 4, viewed in a direction perpendicular to the cutting surface 11, are thicker than the peripheral portions 13 at either side of a narrow aperture 7*b*. Again, the aperture bounded by a thick peripheral portion at one side and by a thin peripheral portion at the other side should not be as wide as that between two thick peripheral portions but should have such a width that no irritation of the skin occurs during shaving.

It is evident that many different configurations of hair-entry apertures are possible. The width of the lamellae or of the foil material between the hair-entry apertures need not be constant but may vary, as is shown in FIG. 12.

We claim:

1. A shaving apparatus having at least one cutting unit comprising an external cutting member and an internal cutting member which is drivable relative to said external cutting member, which internal cutting member comprises cutting elements having cutting edges, which external cutting member has a plurality of broad and narrow hair-entry apertures which are bounded by peripheral portions of the external cutting member, which peripheral portions have cutting edges for cooperation with the cutting edges of the internal cutting member, a plane common to the cutting edges defining a cutting surface, wherein the peripheral portions which bound the hair-entry apertures, viewed in a direction perpendicular to the cutting surface, have different thicknesses, the width of a hair-entry aperture between two thick peripheral portions being greater than the width of a hair-entry aperture between two thin peripheral portions.

2. A shaving apparatus having at least one cutting unit comprising an external cutting member and an internal cutting member which is drivable relative to said external cutting member, which internal cutting member comprises at least one cutter rim having cutting edges, which external cutting member has at least one slot-shaped hair-entry aperture which is bounded by peripheral portions of the external cutting member, which peripheral portions have cutting edges for cooperation with the cutting edges of the internal cutting member, a plane common to the cutting edges defining a cutting surface, wherein the peripheral portions which bound the hair-entry aperture, viewed in a direction perpendicular to the cutting surface, have alternate areas of different thickness, the width of a hair-entry aperture between two thick peripheral portions being greater than the width of the hair-entry aperture between two thin peripheral portions.

* * * * *